US007252357B2

(12) United States Patent
Hosono

(10) Patent No.: US 7,252,357 B2
(45) Date of Patent: Aug. 7, 2007

(54) LIQUID EJECTING APPARATUS

(75) Inventor: Satoru Hosono, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 10/515,016

(22) PCT Filed: May 20, 2003

(86) PCT No.: PCT/JP03/06285

§ 371 (c)(1),
(2), (4) Date: Nov. 22, 2004

(87) PCT Pub. No.: WO03/097363

PCT Pub. Date: Nov. 27, 2003

(65) Prior Publication Data

US 2005/0231543 A1 Oct. 20, 2005

(30) Foreign Application Priority Data

May 22, 2002 (JP) ..... 2002-147851

(51) Int. Cl.
*B41J 2/205* (2006.01)
*B41J 2/21* (2006.01)

(52) U.S. Cl. ..... 347/15; 347/43

(58) Field of Classification Search ..... 347/43
See application file for complete search history.

(56) References Cited

U.S. PATENT DOCUMENTS

2003/0071873 A1 * 4/2003 Kakutani ..... 347/43

FOREIGN PATENT DOCUMENTS

EP 0 893 265 A2 1/1999
EP 955174 A2 * 11/1999
JP 04-026393 A 1/1992
JP 07-195715 A 8/1995
JP 10-044472 2/1998
JP 11-320926 A 11/1999
JP 2000-025251 1/2000
JP 2000-301735 10/2000
JP 2001-191524 A 7/2001
JP 2002-67317 A 3/2002
JP 2002-113852 A 4/2002

OTHER PUBLICATIONS

Japanese Office Action.

* cited by examiner

*Primary Examiner*—Matthew Luu
*Assistant Examiner*—Lisa M. Solomon
(74) *Attorney, Agent, or Firm*—Sughrue Mion, PLLC

(57) ABSTRACT

In the present apparatus, nozzle openings of a pair of adjacent nozzle rows among a plurality of nozzle rows are shifted relative to each other with respect to a direction in which the nozzle rows extend. Liquid of the lightest color is supplied to the nozzle row nearest to an end of a liquid ejecting head with respect to a direction perpendicular to a direction in which the nozzle rows extend, and liquid of the darkest color is supplied to the nozzle row at a middle part of the liquid ejecting head with respect to the direction in which the nozzle rows extend. A controller controls the liquid ejecting head to eject liquids through the nozzle openings of all the plurality of nozzle rows of the liquid ejecting head while the liquid ejecting head is moving for forward and backward scanning strokes. The deterioration of image quality and the increase of approach regions due to the increase of the length of the liquid ejecting head can be prevented.

15 Claims, 8 Drawing Sheets

LIQUID EJECTING APPARATUS

TECHNICAL FIELD

The present invention relates to a liquid ejecting apparatus provided with a liquid ejecting head having a plurality of nozzle rows each of which is formed by arranging a plurality of nozzle openings in a row, and capable of ejecting a plurality of types of liquids.

BACKGROUND ART

An ink-ejecting recording apparatus, i.e., an example of liquid ejecting apparatuses, includes a recording head (liquid ejecting head) having a plurality of nozzle rows each of which is formed by arranging a plurality of nozzle openings in a row, a carriage mechanism for moving the recording head in a main scanning direction (direction along the width of a recording sheet), and a feed mechanism for feeding the recording sheet in a sub-scanning direction (paper feeding direction) perpendicular to the main scanning direction.

The recording head is provided with pressure chambers communicating with the nozzle openings, and pressure-producing elements for varying ink pressure in the pressure chambers. Discharge pulses are applied to the pressure-producing elements of the recording head to change ink pressure in the pressure chambers such that ink particles are ejected through the nozzle openings.

The recording head moving in the main scanning direction ejects ink particles at times specified by dot-pattern data. Upon the arrival of the recording head at the terminal end of a scanning range, the feed mechanism feeds the recording sheet in the sub-scanning direction, and the carriage mechanism starts moving the recording head in the main scanning direction and the recording head ejects ink particles while the same is moving in the main scanning direction.

The foregoing steps of a recording operation are repeated to record an image on the recording sheet in a dot matrix specified by the dot pattern data.

The recording head of the ink-ejecting recording apparatus of this type is capable of ejecting inks of different colors, for example, inks of four colors, such as black, cyan, magenta and yellow. Some recording head is capable of ejecting seven color inks, such as black, cyan, light cyan, magenta, light magenta, yellow and dark yellow inks, to record high-quality color images.

A previously proposed ink-ejecting recording apparatus capable of printing color images as mentioned above is able to operate selectively in either of a high-speed printing mode and a high-quality printing mode according to the purpose of the user. When the ink-ejecting recording apparatus is set for operation in the high-speed printing mode, the four color inks, namely, the black, cyan, magenta and yellow inks, are used for a four-color printing mode. When the ink-ejecting recording apparatus is set for operation in the high-quality printing mode, the seven color inks, namely, the black, cyan, light-cyan, magenta, light-magenta, yellow and dark yellow inks, are used for operation in a seven-color printing mode.

To enable the ink-ejecting recording apparatus to operate selectively in either of the four-color printing mode (high-speed printing mode) and the seven-color printing mode (high-quality printing mode), the recording head is provided with nozzle rows respectively for the seven color inks. If two nozzle rows are assigned to the black ink that is frequently used, the recording head is provided with eight nozzle rows.

However, the dimension of the recording head along the main scanning direction increases with the increase of the number of the nozzle rows. Therefore, picture quality will be significantly deteriorated due to the incorrect positional relation between the recording head and the recording sheet that will occur when the recording head is incorrectly positioned or the recording sheet is dislocated.

Generally, the ink-ejecting recording apparatus has a printing region of a predetermined length, and approach regions extending outward from the opposite ends of the printing regions in the main scanning directions. When the recording head is reversed after being stopped at the end of a forward (or backward) scanning stroke for a backward (or forward) scanning stroke, the recording head starts moving at a moving speed of zero, and then the recording head is accelerated to a predetermined scanning speed. Therefore an approach region is necessary to accelerate the recording head to the predetermined scanning speed before the recording head enters the printing region.

When the dimension of the recording head in the main scanning direction increases due to the foregoing reasons, the necessary width of the approach regions on the opposite outer sides of the printing region increases inevitably.

When the recording mode of the liquid ejecting apparatus capable of operating selectively in either of the four-color printing mode (high-speed printing mode) and the seven-color printing mode (high-quality printing mode), the types of the liquids supplied to the liquid ejecting head are changed. The types of the liquids can be changed by changing, for example, ink cartridges. In such a case, predetermined types of ink cartridges meeting the recording mode must be correctly installed.

DISCLOSURE OF THE INVENTION

The present invention has been made in view of the foregoing circumstances and it is therefore an object of the present invention to provide a liquid ejecting apparatus capable of preventing the deterioration of image quality and the increase of approach regions due to the increase of the dimension of a liquid ejecting head included in the liquid ejecting apparatus.

Another object of the present invention is to provide a liquid ejecting apparatus capable of changing the combination of types of liquids without difficulty when the operating mode thereof is changed from a high-speed printing mode, such as a four-color printing mode, to a high-quality printing mode, such as a seven-color printing mode, and vice versa.

In order to achieve the above-mentioned object, a liquid ejecting apparatus according to the present invention includes: a liquid ejecting head provided with a plurality of nozzle rows each of which is formed by arranging a plurality of nozzle openings in a row, and capable of ejecting a plurality of types of liquids, a liquid of lightest color being supplied to the nozzle row nearest to an end of the liquid ejecting head with respect to a direction perpendicular to a direction in which the nozzle rows extend, and a liquid of darkest color being supplied to the nozzle row at a middle part of the liquid ejecting head with respect to the direction in which the nozzle rows extend; a carriage mechanism including a carriage carrying the liquid ejecting head and capable of moving the carriage carrying the liquid ejecting head in scanning directions perpendicular to the direction in which the nozzle rows extend; and a controller capable of controlling the liquid ejecting head to eject the liquids through all of the plurality of nozzle rows of the liquid ejecting head both while the liquid ejecting head is being moved for a forward scanning stroke and while the liquid ejecting head is being moved for a backward scanning stroke.

Preferably, the nozzle openings of a pair of adjacent nozzle rows among the plurality of nozzle rows are shifted relative to each other with respect to the direction in which the nozzle rows extend.

Preferably, the liquids are supplied to the plurality of nozzle rows such that colors of the liquids are symmetrically arranged with respect to the direction perpendicular to the direction in which the nozzle rows extend, and the carriage is configured to detachably hold at least two cartridges containing the liquids to be supplied to the plurality of nozzle rows, the carriage being configured such that only one or more cartridges for at least a part of the plurality of nozzle rows in either a right half part or a left half part of the liquid ejecting head can be replaced with other cartridges containing other liquids of similar color classes, respectively.

Preferably, the other cartridges containing the other liquids of similar color classes are provided with matching projections for preventing a false insertion, and the carriage is provided with matching recesses for receiving the matching projections when the other cartridges containing the other liquids of the similar color classes are mounted on the carriage.

Preferably, only the other cartridges containing the other liquids of the similar color classes are provided with storage devices storing information about the colors of the other liquids contained in the other cartridges, respectively, and the carriage is provided with reading means for reading the information about the colors of the other liquids stored in the storage devices.

Preferably, colors of the liquids respectively supplied to the plurality of the nozzle rows change from a dark color for the nozzle row at the middle part of the liquid ejecting head to a light color for the nozzle row nearest to the end of the liquid ejecting head with respect to the direction perpendicular to the direction in which the nozzle rows extend.

Preferably, the number of the plurality of nozzle rows of the liquid ejecting head is eight.

Preferably, a black-class ink is ejected through a pair of adjacent nozzle rows in the middle part of the liquid ejecting head with respect to the direction perpendicular to the direction in which the nozzle rows extend, a cyan-class ink is ejected through a pair of nozzle rows outwardly adjacent to the pair of nozzle rows through which the black-class ink is ejected, a magenta-class ink is ejected through a pair of nozzle rows outwardly adjacent to the pair of nozzle rows through which the cyan-class ink is ejected, and a yellow-class ink is ejected through a pair of nozzle rows outwardly adjacent to the pair of nozzle rows through which the magenta-class ink is ejected.

Preferably, the black-class ink includes a black ink, the cyan-class ink includes cyan and light-cyan inks, the magenta-class ink includes magenta and light-magenta inks, the yellow-class ink includes yellow and dark-yellow inks, the cyan ink and the light-cyan ink are ejected through the pair of nozzle rows for the cyan-class inks, respectively, the magenta ink and the light-magenta ink are ejected through the pair of nozzle rows for the magenta-class inks, respectively, and the yellow ink and the dark-yellow ink are ejected through the pair of nozzle rows for the yellow-class inks, respectively, when the liquid ejecting head is operated in a seven-color recording mode, and the cyan ink is ejected through the pair of nozzle rows for the cyan-class inks, the magenta ink is ejected through the pair of nozzle rows for the magenta-class inks, and the yellow ink is ejected through the pair of nozzle rows for the yellow-class inks when the liquid ejecting head is operated in a four-color recording mode.

The black-class ink includes black and light-black inks, the cyan-class ink includes cyan and light-cyan inks, the magenta-class ink includes magenta and light-magenta inks, the yellow-class ink includes yellow and dark-yellow inks, the black and the light-black ink are ejected through the pair of nozzle rows for the black-class inks, respectively, the cyan ink and the light-cyan ink are ejected through the pair of nozzle rows for the cyan-class inks, respectively, the magenta ink and the light-magenta ink are ejected through the pair of nozzle rows for the magenta-class inks, respectively, and the yellow ink and the dark-yellow ink are ejected through the pair of nozzle rows for the yellow-class inks, respectively, when the liquid ejecting head is operated in an eight-color recording mode, and the black ink is ejected through the pair of nozzle rows for the black-class inks, the cyan ink is ejected through the pair of nozzle rows for the cyan-class inks, the magenta ink is ejected through the pair of nozzle rows for the magenta-class inks, and the yellow ink is ejected through the pair of nozzle rows for the yellow-class inks when the liquid ejecting head is operated in a four-color recording mode.

Preferably, the carriage is configured to detachably and individually hold the cartridges respectively containing the liquids of different colors to be ejected by the liquid ejecting head, the liquid ejecting apparatus further including liquid type recognizing means for recognizing types of the liquids contained in the cartridges based on information provided from the cartridges and for deciding if the cartridges contain proper types of liquids selectively determined according to the recording mode.

Preferably, the carriage is configured to individually and detachably hold the cartridges respectively containing the liquids of different colors to be ejected by the liquid ejecting head, the liquid ejecting apparatus further including recording mode selecting means for recognizing types of the liquids contained in the cartridges based on information provided from the cartridges and selecting one of the recording modes according to the types of the liquids contained in the cartridges.

Preferably, the carriage is provided with a plurality of liquid supply needles to be inserted in the cartridges of respective colors.

Preferably, the liquid ejecting head is provided with a plurality of pressure chambers respectively communicating with the plurality of nozzle openings, and pressure-producing elements for varying ink pressure in the pressure chambers, the pressure-producing elements including transverse or longitudinal mode piezoelectric vibrators.

The present invention prevents the deterioration of image quality and the increase of approach regions due to the increase of the dimension of a liquid ejecting head included in the liquid ejecting apparatus.

The present invention achieves changing the combination of types of liquids without difficulty when the operating mode is changed from a high-speed printing mode, such as a four-color printing mode, to a high-quality printing mode, such as a seven-color printing mode, and vice versa.

BEST MODE FOR CARRYING OUT THE INVENTION

An ink-ejecting recording apparatus provided with an ink-ejecting recording head will be described with reference to the accompanying drawings as an example of a liquid ejecting apparatus according to the present invention.

Figure 1:
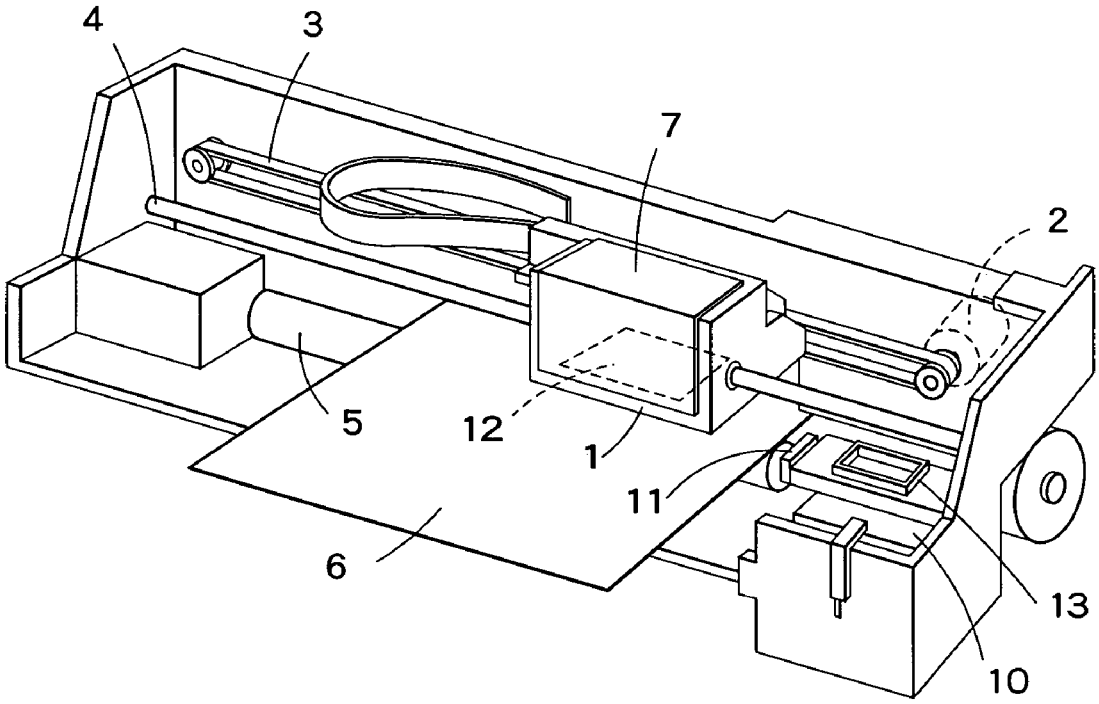
FIG. 1 is a schematic perspective view of an ink-ejecting recording apparatus in a first embodiment of the liquid ejecting apparatus according to the present invention.

Referring to FIG. 1 showing an ink-ejecting recording apparatus in a first embodiment according to the present invention in a schematic perspective view, a carriage 1 is connected to a timing belt 3, and a carriage drive motor 2 drives the timing belt 3 to move the carriage 1 guided by a guide member 4 for transverse reciprocation along the axis of a platen 5. The carriage 1, the carriage drive motor 2, the timing belt 3 and the guide member 4 constitute a carriage mechanism for moving an ink-ejecting recording head 12 together with the carriage 1 in main scanning directions.

The ink-ejecting recording head 12 is mounted on the carriage 1 so as to face a recording sheet 6. Ink cartridges 7 for supplying inks to the recording head 12 are detachably mounted on the carriage 1 above the recording head 12.

A cap 13 is disposed at a home position in a right approach region, as viewed in FIG. 1, of the ink-ejecting recording apparatus. The cap 13 is pressed against a working surface, in which nozzle openings open, of the recording head 12 such that a sealed space is formed between the cap 13 and the working surface when the recording head 12 is positioned at the home position. A pump unit 10 is disposed below the cap 13 to produce a negative pressure in the sealed space between the cap 13 and the working surface.

A wiping device 11 provided with an elastic plate of rubber or the like is held at a position near the cap on the side of a printing region, for example, so as to be horizontally movable relative to the moving path of the recording head 12.

The wiping device 11 is able to wipe the working surface of the recording head 12 when necessary as the carriage 1 moves forward/backward in a region on the side of the cap 13.

The ink-ejecting recording apparatus is provided with a feed mechanism for intermittently feeding the recording sheet 6, on which the recording head 12 records images, in a sub-scanning direction perpendicular to the main scanning directions.

Figure 2:
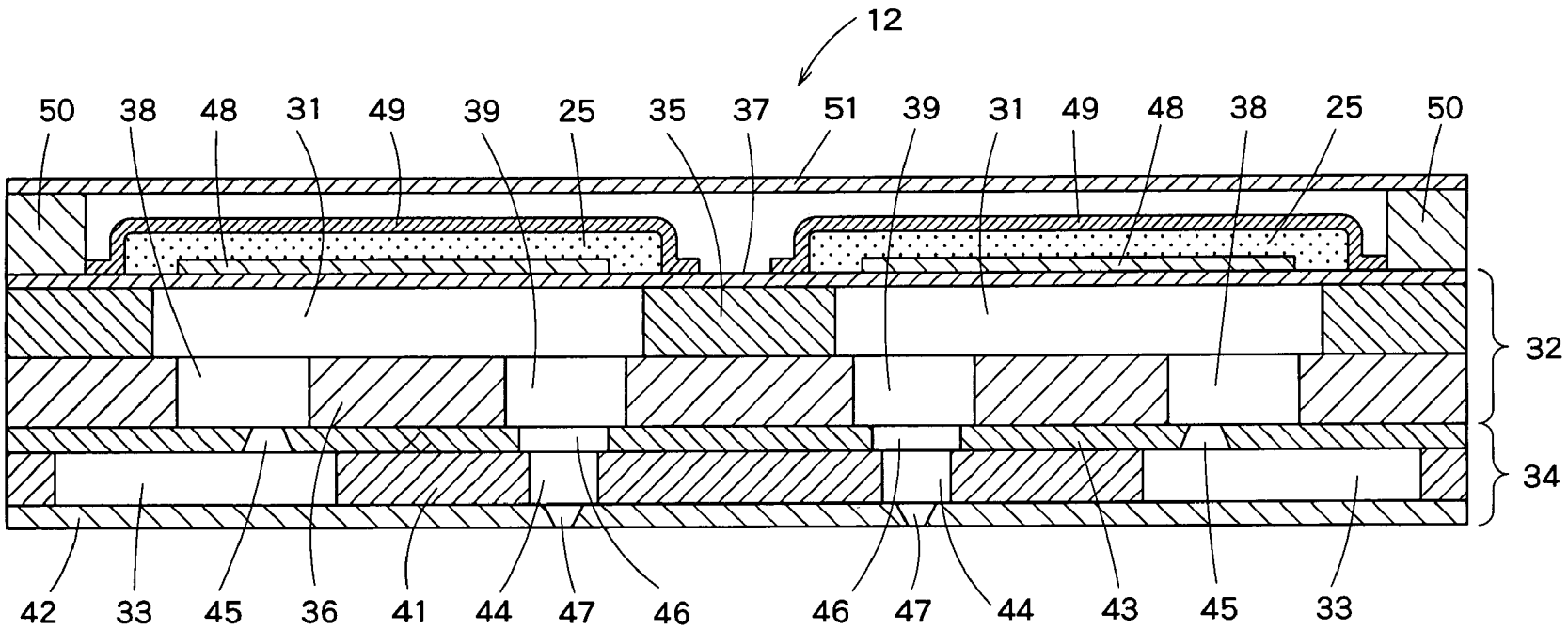
FIG. 2 is a sectional view of a recording head included in the ink-ejecting recording apparatus shown in FIG. 1.

Referring to FIG. 2 showing the ink-ejecting recording head 12 included in the ink-ejecting recording apparatus shown in FIG. 1 in a sectional view, the recording head 12 has an actuator unit 32 provided with a plurality of pressure chambers 31, a passage unit 34 provided with nozzle openings 47 and common ink chambers 33, and piezoelectric vibrators 25. The passage unit 34 is joined to the front surface of the actuator nit 32, and the piezoelectric vibrators 25 are disposed on the back surface of the actuator unit 32.

Each pressure chamber 31 expands and contracts as the piezoelectric vibrator 25 warps to vary ink pressure in the pressure chamber 31. Ink particles (liquid particles) are ejected through the nozzle openings 47 when the ink pressure in the pressure chambers 31 is varied. For example, the pressure chambers 31 are contracted sharply to increase the pressure in the pressure chambers 31 so that ink particles are ejected through the nozzle openings 47.

The actuator unit 32 has a pressure chamber plate 35 provided with spaces for forming the pressure chambers 31, a cover member 36 joined to the front surface of the pressure chamber plate 35, and a vibrating plate 37 joined to the back surface f the pressure chamber plate 35 so as to cover the open ends of the spaces. The cover member 36 is provided with first ink passages 38 connecting the common ink chambers 33 and the pressure chambers 31, and second ink passages 39 connecting the pressure chambers 31 and the nozzle openings 47.

The passage unit 34 has an ink chamber plate 41 provided with spaces for forming the common ink chambers 33, a nozzle plate 42 provided with the plurality of nozzle openings 47 and joined to the front surface of the ink chamber plate 41, and an ink supply plate 43 joined to the back surface of the ink chamber plate 41.

The ink chamber plate 41 is provided with connecting holes 44 connected to the nozzle openings 47. The ink supply plate 43 is provided with ink supply ports 45 connecting the common ink chambers 33 and the first ink passages 38, and connecting holes 46 connecting the connecting holes 44 and the second ink passages 39.

Ink passages extend from the common ink chambers 33 through the pressure chambers 31 to the nozzle openings 47 in the recording head 12.

The piezoelectric vibrator 25 is disposed on the back side of the vibrating plate 37 opposite the side of the pressure chamber 31. The piezoelectric vibrator 25 has the shape of a flat plate. A lower electrode 48 is formed on the front surface of the piezoelectric vibrator 25, and an upper electrode 49 is formed so as to cover the back surface of the piezoelectric vibrator 25.

Terminals 50 having base parts electrically connected to the upper electrodes 49 of the piezoelectric vibrators 25 are formed in the opposite end parts of the actuator unit 32. The free end surfaces of the terminals 50 are at a level above that of the piezoelectric vibrators 25. Drive signals are applied through the terminals 50 and the upper electrodes 49 to the piezoelectric vibrator 25.

Although only the two pressure chambers 31, the two piezoelectric vibrators 25 and the two terminals 50 are shown in FIG. 2, the recording head 12 is provided with one pressure chamber 31, one piezoelectric vibrator 25 and one terminal 50 for each nozzle opening 47.

In this recording head 12, a discharge pulse is applied to the piezoelectric vibrator 25 to produce a voltage difference between the upper electrode 49 and the lower electrode 48.

Consequently, the piezoelectric vibrator 25 contracts in a direction perpendicular to the direction of an electric field applied thereto. Since only the upper electrode 49 contracts and the lower electrode 48 of the piezoelectric vibrator 25 bonded to the vibrating plate 37 does not contract, the piezoelectric vibrator 25 and the vibrating plate 37 warp so as to protrude toward the pressure chamber 31, and thereby the volume of the pressure chamber 31 is decreased.

To eject an ink particle through the nozzle openings 47, the pressure chamber 31 contracted to some extent is expanded temporarily to suck the ink into the pressure chamber 31, and the pressure chamber is contracted sharply. Consequently, the ink pressure in the pressure chamber 31 increases and thereby the ink contained in the pressure chamber 31 is ejected in an ink particle through the nozzle opening 47. The voltage applied to the upper electrode 49 is reduced to a reference voltage (intermediate potential) to expand the contracted pressure chamber 31 after an ink particle has been ejected. Consequently, the ink is supplied from the common ink chamber through the ink supply port 45 into the pressure chamber 31 and the oscillation of the meniscus is suppressed.

Figure 3:
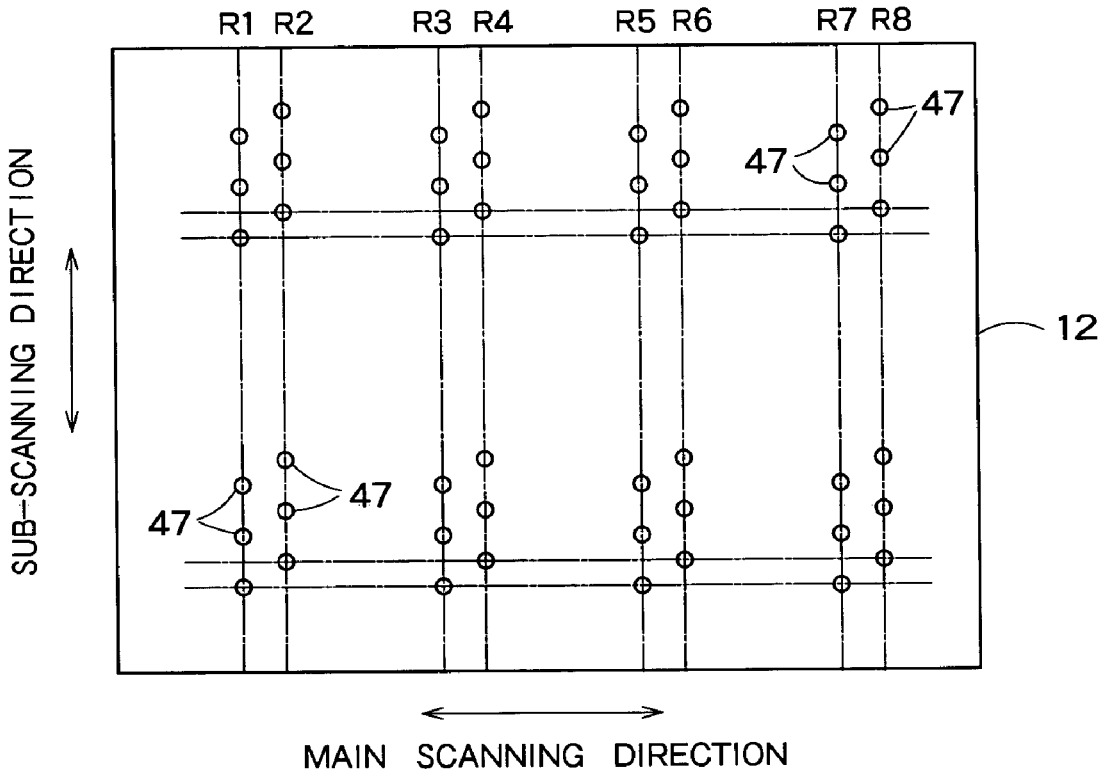
FIG. 3 is a plan view of a nozzle-forming plane in the recording head shown in FIG. 2.

FIG. 3 is a plan view of a nozzle forming plane in the recording head 12 capable of ejecting ink particles of a plurality of types of inks. As shown in FIG. 3, the plurality of nozzle openings are arranged in nozzle rows R1, R2, R3, R4, R5, R6, R7 and R8 extending in the sub-scanning direction, and the eight nozzle rows R1 to R8 are arranged in the main scanning direction.

The respective nozzle openings 47 of the two adjacent nozzle rows, for example, the nozzle rows R1 and R2, among the eight nozzle rows R1 to R8 are displaced by a predetermined distance in the sub-scanning direction relative to each other. The respective nozzle openings 47 of the alternate nozzle rows, for example the nozzle rows R1 and R3, coincide with each other with respect to the sub-scanning direction.

In the recording head 12 included in the first embodiment, inks of the darkest colors are supplied to the nozzle rows R4 and R5 in the middle part of the arrangement of the nozzle rows R1 to R8 with respect to the main scanning direction perpendicular to the sub-scanning direction, and colors of inks supplied to the nozzle rows farther from the nozzle rows R4 and R5 are lighter, i.e., the nozzle rows R3 to R1 and the nozzle rows R6 to R8, and inks of the lightest colors are supplied to the nozzle rows R1 and R8.

More concretely, black-class ink is ejected through the nozzle openings 47 of the two adjacent middle nozzle rows R4 and R5 in the middle part of the recording head 12 with respect to directions perpendicular to the direction in which the nozzle rows extend (main scanning direction), cyan-class inks are ejected through the nozzle openings of the two nozzle rows R3 and R6 adjacent to and lying on the outer side of the two middle nozzle rows R4 and R5, magenta-class inks are ejected through the nozzle openings 47 of the two nozzle rows R2 and R7 adjacent to and lying on the outer side of the two nozzle rows R3 and R6, and yellow-class inks are ejected through the nozzle openings of the two nozzle rows R1 and R8 adjacent to and lying on the outer side of the two nozzle rows R2 and R7.

The black-class ink is black ink, the cyan-class inks are cyan and light-cyan inks, the magenta-class inks are magenta and light-magenta inks, and the yellow-class inks are yellow and dark-yellow inks.

The ink-ejecting recording apparatus in this embodiment is capable of operating selectively in either of a seven-color recording mode (high-quality recording mode) and a four-color recording mode (high-speed recording mode). When the ink-ejecting recording apparatus is operated in the seven-color recording mode, the light cyan ink is ejected through the nozzle openings 47 of the nozzle row R3, the cyan ink is ejected through the nozzle openings 47 of the nozzle row R6, the light-magenta ink is ejected through the nozzle openings 47 of the nozzle row R2, the magenta ink is ejected through the nozzle openings 47 of the nozzle row R7, the light-dark yellow ink is ejected through the nozzle openings 47 of the nozzle row R1, and the yellow ink is ejected through the nozzle openings 47 of the nozzle row R8.

When the ink-ejecting recording apparatus is operated in the four-color recording mode, the cyan ink is ejected through the nozzle openings 47 of both the nozzle rows R3 and R6, the magenta ink is ejected through the nozzle openings 47 of both the nozzle row R2 and R7, and the yellow ink is ejected through the nozzle openings 47 of both the nozzle row R1 and R8.

Figure 4A:
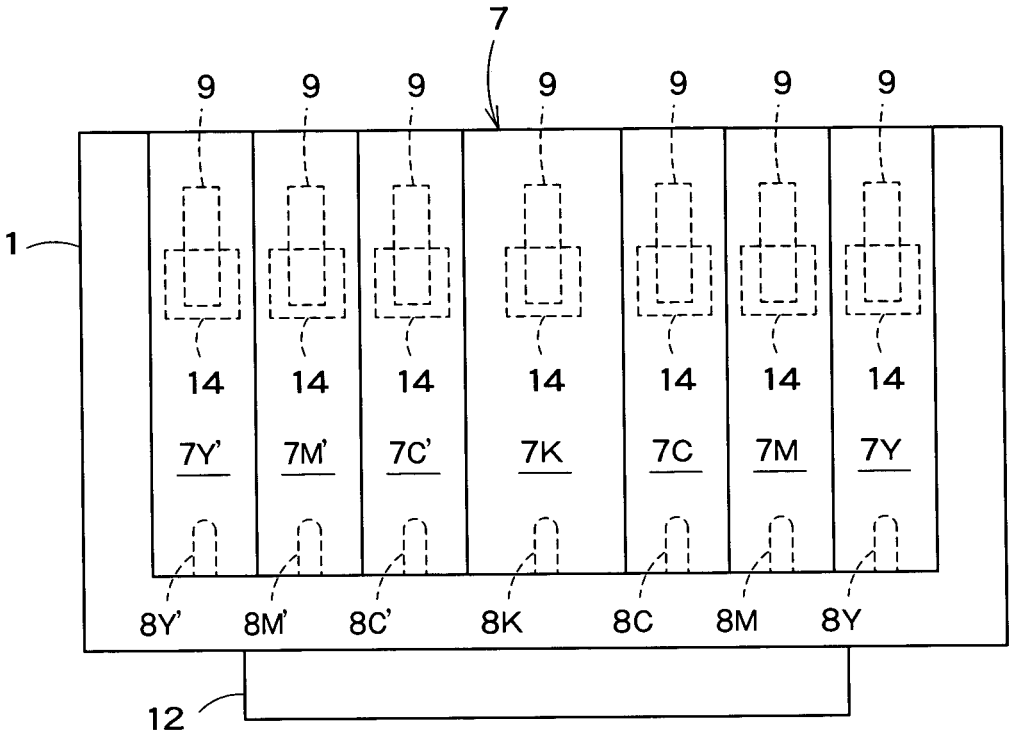
FIG. 4A is an enlarged view of a carriage and cartridges included in the ink-ejecting recording apparatus shown in FIG. 1.

As shown in FIG. 1, the cartridges 7 can be detachably mounted on the carriage 1 of the ink-ejecting recording apparatus. More concretely, cartridges 7K, 7C, 7C', 7M, 7M', 7Y and 7Y' containing the color inks to be ejected by the recording head 12 are individually detachable from the carriage 1 as shown in FIG. 4A. The cartridges 7K, 7C, 7C', 7M, 7M', 7Y and 7Y' contain black, cyan, light-cyan, magenta, light-magenta, yellow and dark-yellow inks, respectively.

The carriage 1 is provided with ink supply needles 8K, 8C, 8C', 8M, 8M', 8Y and 8Y' to be inserted in the cartridges 7K, 7C, 7C', 7M, 7M', 7Y and 7Y', respectively. The black ink contained in the cartridge 7K is supplied through one ink supply needle 8K inserted in the cartridge 7K to the two nozzle rows R4 and R5.

Terminals 9 are arranged so as to correspond to the cartridges 7K, 7C, 7C', 7M, 7M', 7Y and 7Y', respectively. The terminals 9 are information reading means for electrically reading information stored in contact ROMs (storage devices) 14 attached to the cartridges 7K, 7C, 7C', 7M, 7M', 7Y and 7Y'. The information stored in each ROM includes the type of the ink contained in the corresponding cartridge. When the cartridges 7K, 7C, 7C', 7M, 7M', 7Y and 7Y' are mounted on the carriage 1, the terminals of the contact ROMs 14 come into electrical contact with the corresponding terminals 9, respectively.

Figure 4B:
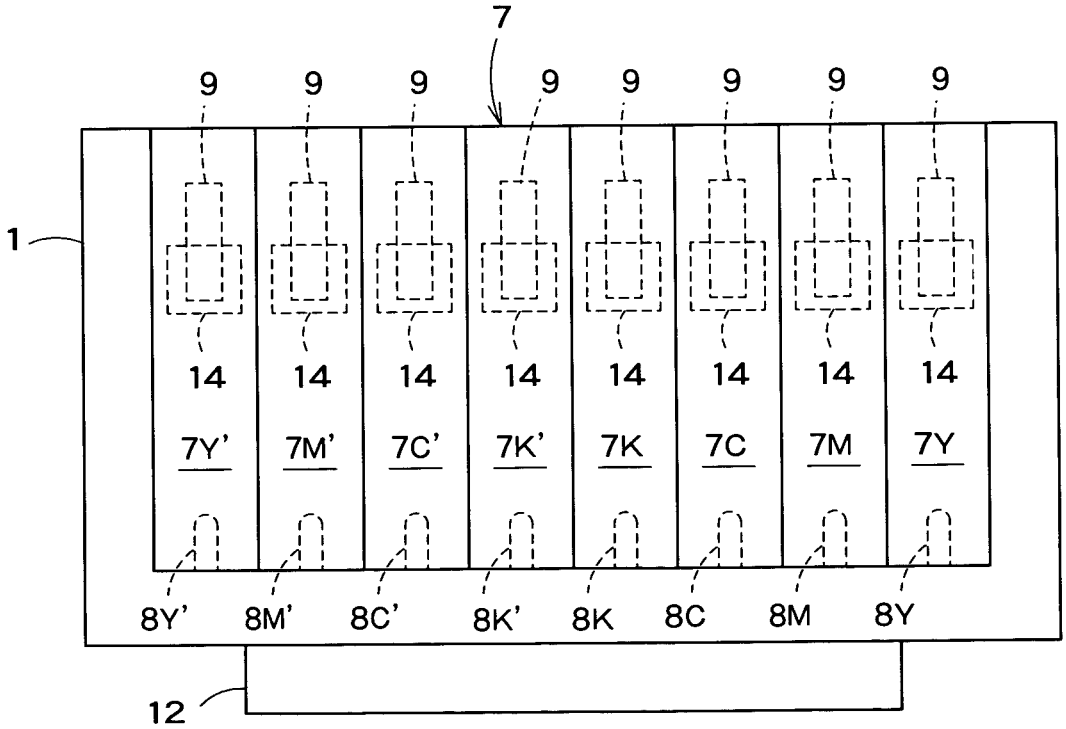
FIG. 4B is a view of a carriage and cartridges in a modification of the carriage and the cartridges shown in FIG. 4A.

FIG. 4B shows ink cartridges and a carriage in a modification. Two cartridges 7K and 7K' respectively containing black-class inks are mounted on a carriage 1. The cartridge 7K contains a black ink and the cartridge 7K' contains a light-black ink. Thus, the carriage 1 is provided with two ink supply needles 8K and 8K' respectively for supplying the black ink and the light-black ink.

The carriage 1 and the eight cartridges 7K, 7K', 7C, 7C', 7M, 7M', 7Y and 7Y' are used for printing in an eight-color recording mode. When the ink-ejecting recording apparatus is operated in the eight-color recording mode, the light-black ink and the black ink are ejected through the nozzle openings 47 of the nozzle rows R4 and R5 shown in FIG. 3, respectively. When the eight-color recording mode is changed for the four-color recording mode, the ink cartridge 7K' containing the light-black ink is replaced with the ink cartridge 7K.

In the recording head 12 shown in FIG. 4B, all the cartridges corresponding to the nozzle rows R1, R2, R3 and R4 in a left-half part of the recording head 12 are replaced with other cartridges containing other types of inks of the same color classes, respectively.

Figure 5:
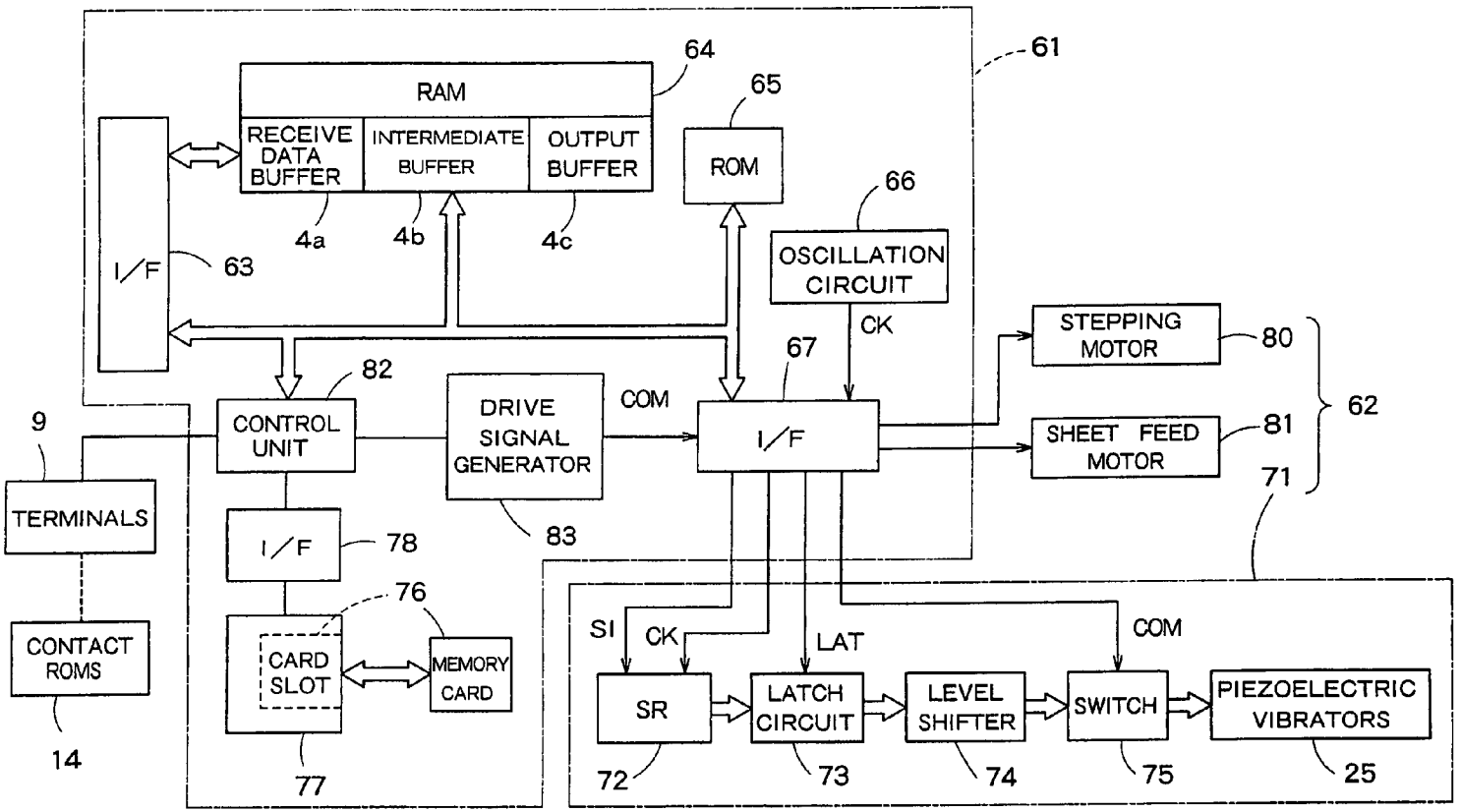
FIG. 5 is a block diagram of the functional configuration of the ink-ejecting recording apparatus shown in FIG. 1.

Referring to FIG. 5 showing the functions of the ink-ejecting recording apparatus in this embodiment in a block diagram, the ink-ejecting recording apparatus includes a printer controller 61 and a print engine 62. The print controller 61 includes an interface 63 for receiving printing data and such from a host computer, not shown, a RAM 64 for storing data, a ROM 65 storing control routines for controlling data processing operations, a control unit 82 including a CPU or the like, an oscillation circuit 66, a drive signal generator (drive signal generating means) 83 that generates drive signals, and an interface 67 for sending printing data in the form of dot-pattern data (bit map data) and drive signals to the print engine 62.

The print controller 61 has a card slot 77 for detachably receiving a memory card 76, i.e., a recording medium, and a card interface 78 capable of reading information from the memory card 76 and sending the information to the control unit 82. The memory card 76 stores data on the waveforms of drive signals. A recording medium, such as a floppy disk, a hard disk, a magnetooptical disk or the like, other than the memory card 76 may be used.

The control unit 82 is a computer capable of controlling an ink ejecting operation for ejecting ink particles according to the waveform data on the wave form of a drive signal stored in the memory card 76 and a control routine stored in the ROM 65.

The control unit 82 is capable of controlling the recording head 12 such that ink particles are ejected through the nozzle openings 47 of all the nozzle rows R1, R2, 43, R4, R5, R6, R7 and R8 while the recording head 12 is in forward and backward main scanning directions. Consequently, the recording head 12 ejects the seven color inks both while the recording head 12 is moving in the forward main scanning direction and while the same is moving in the backward main scanning direction for printing in the seven-color recording mode.

The interface 63 receives printing data including one or all of, of for example, character code data, graphic function data and image data from the host computer. The interface 63 is able to send a busy signal (signal BUSY), an acknowledge signal (signal ACK) and such to the host computer.

The RAM 64 serves as a receive data buffer, an intermediate buffer, and an output buffer and a work memory, not shown. The receive data buffer temporarily stores printing data provided by the host computer, the intermediate buffer stores intermediate code data, and the output buffer stores dot pattern data.

The ROM 65 stores control routines to be executed by the control unit 82, font data and graphic functions.

The ROM 65 stores fixed control routine (control programs) that are not subject to change and are to be used permanently. Data subject to future version up or change, such as data on the waveform of drive signals and the like, is stored in the memory card 76.

The control unit 82 controls the drive signal generator 83 on the basis of data on the waveforms of drive signals read from the memory card 76 to generate predetermined drive signals according to the printing mode.

The print engine 62 includes a stepping motor 80 for driving the recording head 12 for movement in the main scanning directions, a sheet-feed motor 81 for feeding a recording sheet, and an electrical drive system 71 included in the recording head 12. The electrical drive system 71 of the recording head 12 includes a shift register 72, a latch circuit 73, a level shifter 74, a switch 75 and the piezoelectric vibrators 25. The shift register 72, the latch circuit 73, the level shifter 74 and the switch 75 constitute a pulse generator.

When the ink cartridges 7K, 7C, 7C', 7M, 7M', 7Y and 7Y' are mounted on the carriage 1 as shown in FIG. 4A, the terminals of the contact ROMs 14 are connected electrically to the terminals 9. Consequently, the control unit 82 of the printer controller 61 shown in FIG. 5 is able to read the information stored in the contact ROMs 14 through the terminals 9. The contact ROMs 14 may be reloadable storage devices, such as EEPROMs.

The control unit 82 includes an ink type examining device capable of recognizing the types of the inks contained in the cartridges 7 on the basis of information read from the contact ROMs 14 of the cartridges 7, and of deciding whether or not the types of the inks contained in the cartridges 7 correspond to those determined for the seven-color or the four-color recording mode.

The examining device generates a warning sound or displays a warning if the same decides that the cartridges 7 do not contain inks of the desired types to prompt the user to inspect the cartridges 7.

The control unit 82 may include, instead of the ink type examining device or in addition to the ink type examining device, a recording mode selecting device capable of recognizing the types of the inks contained in the cartridges 7 on the basis of information read from the contact ROMs 14 of the cartridges and selecting either the seven-color or the four-color recording mode according to the types of the inks contained in the cartridges 7.

The mode selecting device sets the ink-ejecting recording apparatus for operation in either the seven-color or the four-color recording mode according to the types of the inks contained in the cartridges mounted on the carriage 1. Thus, the proper recording mode for a recording operation using the types of the inks contained in the cartridges 7 mounted on the carriage 1 may be automatically selected.

The control unit 82 may be the host computer connected directly to the ink-ejecting recording apparatus, or may be one of a plurality of computers included in a network.

As mentioned above, in the recording head 12 included in the first embodiment, the yellow inks, i.e., the inks of the lightest color, are supplied to the nozzle rows R1 and R8 at the opposite ends of the arrangement of the eight nozzle rows R1 to R8 with respect to the main scanning directions, and the black ink, i.e., the ink of the darkest color, is supplied to the nozzle rows R4 and R5 in the middle part of the arrangement of the nozzle rows R1 to R8 with respect to the main scanning directions If the positional relation between the recording head 12 and the recording sheet 6 is incorrect due to errors in the position of the recording head 12 or the dislocation of the recording sheet 6, dots printed by the inks ejected through the nozzle openings 47 of the nozzle rows R1 and R8 at the opposite ends of the arrangement of the nozzle rows R1 to R8 are affected most significantly by the incorrect positional relation between the recording head 12 and the recording sheet 6.

Since the nozzle rows R1 and R8 for the yellow-class inks, namely, the inks of the lightest colors, are at the opposite ends of the arrangement of the nozzle rows R1 to R8 with respect to the main scanning directions, and hence dots of the yellow-class inks, namely, the inks of the lightest colors, are most significantly affected by the incorrect positional relation between the recording head 12 and the recording sheet 6. Thus, the deterioration of the image quality due to the incorrect positional relation between the recording head 12 and the recording sheet 6 can be limited to the least unavoidable extent.

The first nozzle row R1 is the one that can start ink ejecting operation first after the recording head 12 has started moving for the backward scanning stroke after reaching the terminal end of the forward scanning stroke, and the eighth nozzle row R8 is the one that can start ink ejecting operation first after the recording head 12 has started moving for the forward scanning stroke after reaching the terminal end of the backward scanning stroke. Therefore, the length of approach regions necessary for accelerating the recording head 12 to a predetermined scanning speed is determined taking into consideration the distances through which the nozzle rows R1 and R8 located in nonrecording regions extending outside a printing region to enter the recording region.

Since the yellow-class inks, namely, the inks of the lightest colors, are ejected through the nozzle openings 47 of the nozzle rows R1 and R8 at the opposite ends of the arrangement of the nozzle rows R1 to R8 of the recording head 12 with respect to the main scanning directions in the first embodiment, the yellow-class inks are ejected while the recording head 12 is at the stage of acceleration due to insufficient acceleration when the approach region is set in a distance shorter than a necessary distance. Therefore, the deterioration of the image quality can be suppressed. Thus, the length of the approach regions, which should be secured outside the printing region, may be comparatively short.

Figure 6:
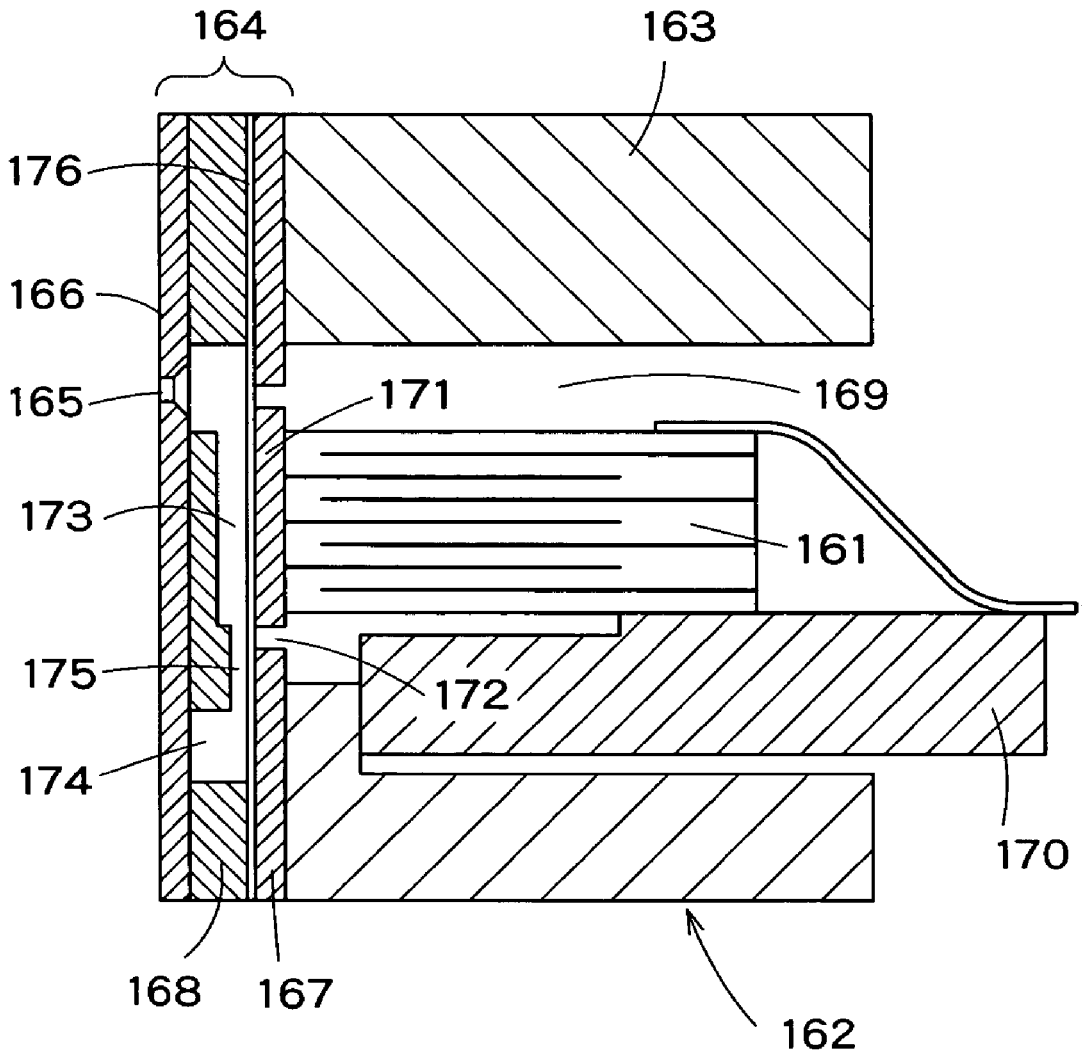
FIG. 6 is a sectional view of another recording head to which the present invention is applicable.

The recording head 12 included in the first embodiment is provided with the transverse mode piezoelectric vibrators 25. The present invention is applicable to a recording head 162 provided with longitudinal mode piezoelectric vibrators 161 shown in FIG. 6.

The recording head 162 includes a base 163 formed of a synthetic resin, and a passage unit 164 attached to the front surface (a surface facing left in FIG. 6) of the base 163. The passage unit 164 has a nozzle plate 166 provided with nozzle openings 165, a vibrating plate 167, a passage plate 168 defining passages, and a sheet 176.

The base 163 has the shape of a block defining a space 169 having front and back open ends. A fixed base plate 170 fixedly holding the piezoelectric vibrators 161 is received in the space 169.

The nozzle plate 166 has the shape of a thin plate and is provided with a plurality of nozzle openings 165 arranged in a sub-scanning direction. The nozzle openings 165 are arranged at predetermined pitches corresponding to a dot density. The vibrating plates 167 and the sheet 176 form thick islands 171 in contact with the piezoelectric vibrators 161, and elastic, thin parts 172 surrounding the islands 171.

The islands 171 are arranged at predetermined pitches so as to correspond to the nozzle openings 165, respectively.

The passage plate 168 is provided with openings for forming pressure chambers 173, common ink chambers 174, and ink supply ports 175 connecting the pressure chambers 173 and the common ink chambers 174.

The passage plate 168 is sandwiched between the nozzle plate 166 and the assembly of the vibration plate 167 and the sheet 176; that is, the nozzle plate 166 is bonded to the front surface of the passage plate 168 with, for example, an adhesive, and the vibrating plate 167 and the sheet 176 are bonded to the back surface of the passage plate 168 with, for example, an adhesive, to form the passage unit 164.

The passage unit 164 has the pressure chambers 173 behind the nozzle openings 165, and the islands 171 of the vibration plate 167 are positioned behind the pressure chambers 173, respectively. The pressure chambers 173 communicate with the common ink chambers 174 by means of the ink supply ports 175.

The piezoelectric vibratos 161 are fixedly held on the base 163 with their working ends abutting the back surface of the islands 171. Drive signals (signals COM) and printing data (data SI) are applied to the piezoelectric vibrators 161 through a flexible cable.

The longitudinal mode piezoelectric vibrators 161 contracts in a direction perpendicular to an electric field applied thereto when charged and extends in the perpendicular to the electric field when discharged. In this recording head 162, the piezoelectric vibrators 161 contract backward when charged pulling the islands 171 backward and, consequently, the pressure chambers 173 expand. Consequently, the inks flow from the common ink chambers 174 through the ink supply ports 175 into the pressure chambers 173 as the pressure chambers 173 expand. The piezoelectric vibrators 161 extend forward when discharged pushing the islands 171 forward and, consequently, the pressure chambers 173 contract. Consequently, the ink pressures in the pressure chambers 173 increase.

The pressure chambers 173 of the recording head 162 expand when the piezoelectric vibrators 161 are charged and contract when the piezoelectric vibrators 161 are discharged, whereas the pressure chambers 31 of the recording head 12 expand when the piezoelectric vibrators 25 are discharged and contract when the piezoelectric vibrators 25 are charged. Thus, the mode of variation of the volume of the pressure chambers 173 according to the charging and discharging of the piezoelectric vibrators 161 is reverse to that of variation of the volume of the pressure chambers 31 of the recording head 12. Therefore, the waveform of drive signals to be applied to the recording head 162 is inverse to that of the drive signals to be applied to the recording head 12 shown in FIG. 2 with respect to the level of the intermediate potential. Thus, the voltage applied to the piezoelectric vibrators 161 is decreased to supply the inks to the pressure chambers 173, and the voltage applied to the piezoelectric vibrators 161 is increased to eject ink particles.

The effects of an ink-ejecting recording apparatus provided with the longitudinal mode recording head 162 are the same as the ink-ejecting recording apparatus in the first embodiment.

An ink-ejecting recording apparatus in a second embodiment according to the present invention will be described with reference to FIGS. 7 to 9. The second embodiment is a modification of the first embodiment and only changes made in the first embodiment will be described.

A carriage 1 included in the second embodiment is constructed such that only cartridges corresponding to nozzle rows R1, R2 and R3 in a left half part of a recording head 12 can be replaced with other cartridges containing inks of other colors in the same color classes as those of the colors of the inks contained in the former cartridges.

Figure 7:
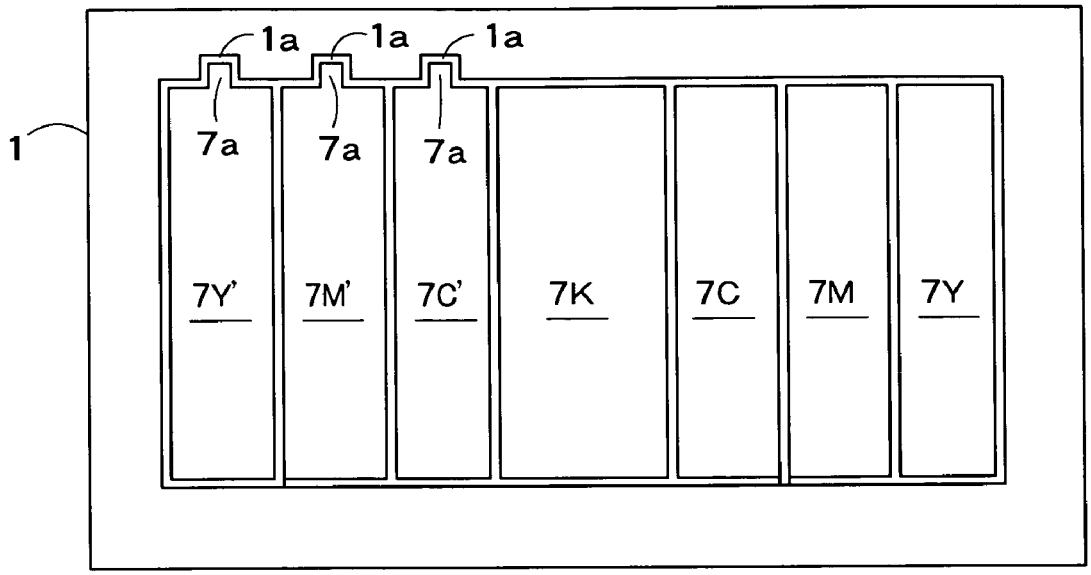
FIG. 7 is a plan view of a carriage and cartridges included in an ink-ejecting recording apparatus in a second embodiment according to the present invention set for a seven-color printing mode.

More concretely, as shown in FIG. 7, ink cartridges 7Y', 7M' and 7C' respectively containing dark yellow, light magenta and light cyan inks are provided with matching projections 7*a*, and a left half part of a wall, facing the matching projections 7*a*, of the carriage 1 is provided with matching recesses 1*a* for receiving the matching projections 7*a* when the ink cartridges 7Y', 7M' and 7C' are mounted on the carriage 1. Any recesses corresponding to the matching recesses 1*a* are not formed in a right half part of the same wall.

Figure 8:
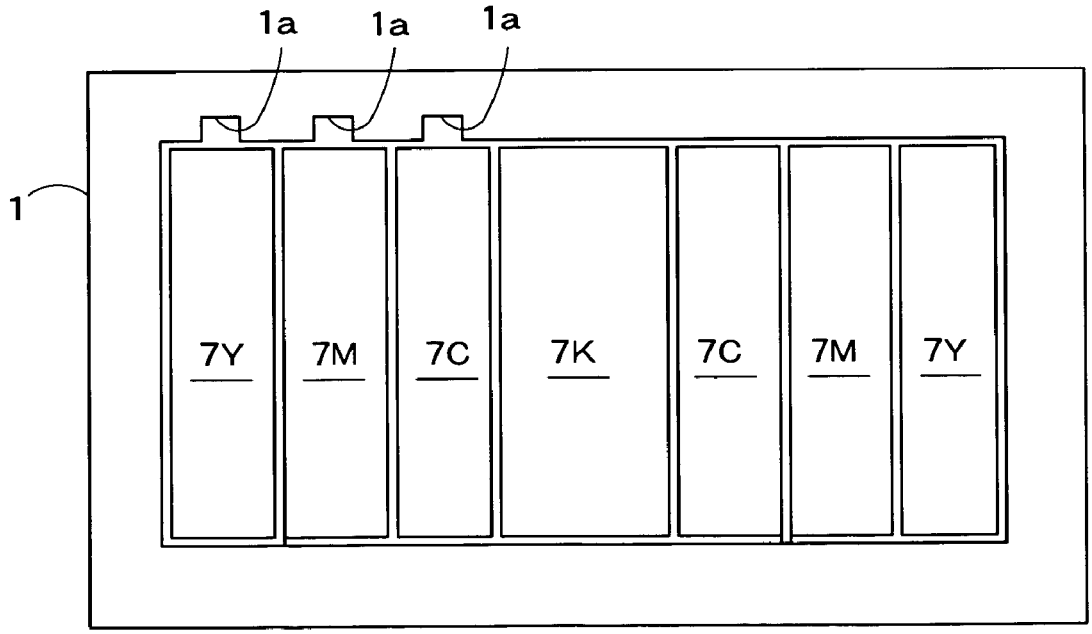
FIG. 8 is a plan view of the carriage and cartridges included in the ink-ejecting recording apparatus in the second embodiment set for a four-color printing mode.

Since the ink cartridges 7Y', 7M' and 7C' are provided with the matching projections 7*a*, and only the left half part of the wall of the carriage 1 is provided with the matching recesses 1*a*, the insertion of the ink cartridges 7Y', 7M' and 7C' respectively containing dark yellow, light magenta and light cyan inks in the right half part of the carriage 1 by mistake can be avoided in changing a cartridge arrangement for the four-color recording mode shown in FIG. 8 to a cartridge arrangement for the seven-color recording mode shown in FIG. 7.

Labels of similar colors are attached to the ink cartridges respectively containing color inks of colors of the same color class and hence those ink cartridges are liable to be mistaken for each other. The second embodiment surely prevents mistaking the ink cartridges containing the color inks of the same color class for each other. The change of the four-color recording mode for the seven-color recording mode can be confirmed only from information provided by contact ROMs 14 attached to the ink cartridges 7Y', 7M' and 7C' respectively containing dark yellow, light magenta and light cyan inks. As mentioned above, the ink cartridges 7Y', 7M' and 7C' are arranged only in the left half part of the carriage 1.

Figure 9:
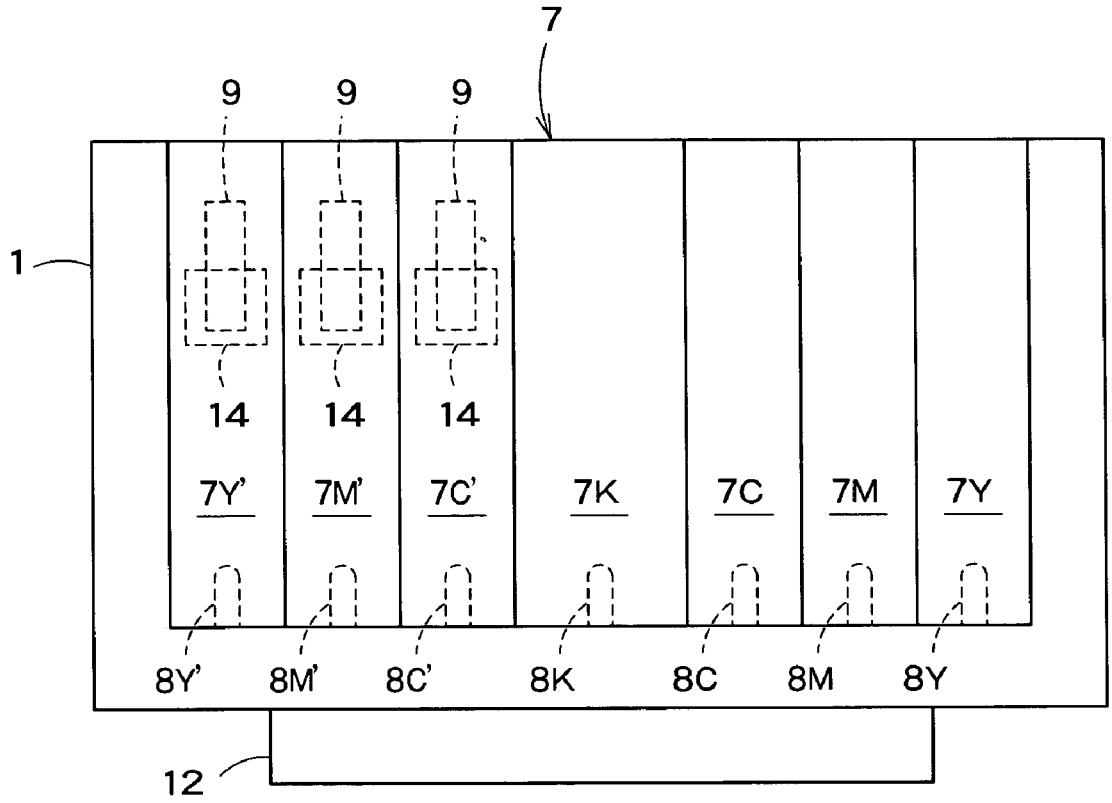
FIG. 9 is a front elevation of the carriage, the cartridges and recording head of the ink-ejecting recording apparatus in the second embodiment set for a seven-color printing mode.

Accordingly, in the second embodiment, ink cartridges 7Y, 7M, 7C and 7K respectively containing yellow, magenta, cyan and black inks do not need to be provided with contact ROMs 14 as shown in FIG. 9, and hence the right half part of the carriage 1 does not need necessarily provided with terminals 9. Thus, the number of the component parts of the ink-ejecting recording apparatus is small and hence the ink-ejecting recording apparatus can be manufactured at a low cost.

Although the invention has been described in its particular embodiments it is obvious to those skilled in the art that various modifications and changes are possible in the embodiments specifically described herein without departing from the scope and spirit of the invention. All changes within the scope of the present invention are set forth in the appended claims.

INDUSTRIAL APPLICABILITY

The present invention is applicable to liquid ejecting apparatuses provided with a liquid ejecting head capable of ejecting a plurality of types of liquids, such as ink-ejecting recording apparatuses.

The invention claimed is:

1. A liquid ejecting apparatus comprising:

a liquid ejecting head provided with a plurality of nozzle rows each of which is formed by arranging a plurality of nozzle openings in a row, and capable of ejecting a plurality of types of liquids, a liquid of lightest color being supplied to the nozzle row nearest to an end of the liquid ejecting head with respect to a direction perpendicular to a direction in which the nozzle rows extend, and a liquid of darkest color being supplied to the nozzle row at a middle part of the liquid ejecting head with respect to the direction in which the nozzle rows extend;

a carriage mechanism including a carriage carrying the liquid ejecting head and capable of moving the carriage carrying the liquid ejecting head in scanning directions perpendicular to the direction in which the nozzle rows extend; and a controller capable of controlling the liquid ejecting head to eject the liquids through all of the plurality of nozzle rows of the liquid ejecting head both while the liquid ejecting head is being moved for a forward scanning stroke and while the liquid ejecting head is being moved for a backward scanning stroke, wherein the liquids are supplied to the plurality of nozzle rows such that colors of the liquids are symmetrically arranged with respect to the direction perpendicular to the direction in which the nozzle rows extend, wherein the carriage is configured to detachably hold at least two cartridges containing the liquids to be supplied to the plurality of nozzle rows, the carriage being configured such that only one or more cartridges for at least a part of the plurality of nozzle rows in either a right half part or a left half part of the liquid ejecting head can be replaced with other cartridges containing other liquids of similar color classes, respectively, and wherein the other cartridges containing the other liquids of similar color classes are provided with matching projections for preventing a false insertion, and the carriage is provided with matching recesses for receiving the matching projections when the other cartridges containing the other liquids of the similar color classes are mounted on the carriage.

2. The liquid ejecting apparatus according to claim 1, wherein the nozzle openings of a pair of adjacent nozzle rows among the plurality of nozzle rows are shifted relative to each other with respect to the direction in which the nozzle rows extend.

3. The liquid ejecting apparatus according to claim 1, wherein only the other cartridges containing the other liquids of the similar color classes are provided with storage devices storing information about the colors of the other liquids contained in the other cartridges, respectively, and the carriage is provided with reading means for reading the information about the colors of the other liquids stored in the storage devices.

4. The liquid ejecting apparatus according to claim 1, wherein colors of the liquids respectively supplied to the plurality of the nozzle rows change from a dark color for the nozzle row at the middle part of the liquid ejecting head to a light color for the nozzle row nearest to the end of the liquid ejecting head with respect to the direction perpendicular to the direction in which the nozzle rows extend.

5. The liquid ejecting apparatus according to claim 4, wherein the number of the plurality of nozzle rows of the liquid ejecting head is eight.

6. The liquid ejecting apparatus according to claim 5, wherein a black-class ink is ejected through a pair of adjacent nozzle rows in the middle part of the liquid ejecting head with respect to the direction perpendicular to the direction in which the nozzle rows extend, a cyan-class ink is ejected through a pair of nozzle rows outwardly adjacent to the pair of nozzle rows through which the black-class ink is ejected, a magenta-class ink is ejected through a pair of nozzle rows outwardly adjacent to the pair of nozzle rows through which the cyan-class ink is ejected, and a yellow-class ink is ejected through a pair of nozzle rows outwardly adjacent to the pair of nozzle rows through which the magenta-class ink is ejected.

7. The liquid ejecting apparatus according to claim 6, wherein:

the black-class ink includes a black ink, the cyan-class ink includes cyan and light-cyan inks, the magenta-class ink includes magenta and light-magenta inks, the yellow-class ink includes yellow and dark-yellow inks, the cyan ink and the light-cyan ink are ejected through the pair of nozzle rows for the cyan-class inks, respectively, the magenta ink and the light-magenta ink are ejected through the pair of nozzle rows for the magenta-class inks, respectively, and the yellow ink and the dark-yellow ink are ejected through the pair of nozzle rows for the yellow-class inks, respectively, when the liquid ejecting head is operated in a seven-color recording mode, and the cyan ink is ejected through the pair of nozzle rows for the cyan-class inks, the magenta ink is ejected through the pair of nozzle rows for the magenta-class inks, and the yellow ink is ejected through the pair of nozzle rows for the yellow-class inks when the liquid ejecting head is operated in a four-color recording mode.

8. The liquid ejecting apparatus according to claim 6, wherein the black-class ink includes black and light-black inks, the cyan-class ink includes cyan and light-cyan inks, the magenta-class ink includes magenta and light-magenta inks, the yellow-class ink includes yellow and dark-yellow inks, the black and the light-black ink are ejected through the pair of nozzle rows for the black-class inks, respectively, the cyan ink and the light-cyan ink are ejected through the pair of nozzle rows for the cyan-class inks, respectively, the magenta ink and the light-magenta ink are ejected through the pair of nozzle rows for the magenta-class inks, respectively, and the yellow ink and the dark-yellow ink are ejected through the pair of nozzle rows for the yellow-class inks, respectively, when the liquid ejecting head is operated in an eight-color recording mode, and the black ink is ejected through the pair of nozzle rows for the black-class inks, the cyan ink is ejected through the pair of nozzle rows for the cyan-class inks, the magenta ink is ejected through the pair of nozzle rows for the magenta-class inks, and the yellow ink is ejected through the pair of nozzle rows for the yellow-class inks when the liquid ejecting head is operated in a four-color recording mode.

9. The liquid ejecting apparatus according to claim 7, wherein the carriage is configured to detachably and individually hold the cartridges respectively containing the liquids of different colors to be ejected by the liquid ejecting head, the liquid ejecting apparatus further comprising liquid type recognizing means for recognizing types of the liquids contained in the cartridges based on information provided from the cartridges and for deciding if the cartridges contain proper types of liquids selectively determined according to the recording mode.

10. The liquid ejecting apparatus according to claim 7, wherein the carriage is configured to individually and detachably hold the cartridges respectively containing the liquids of different colors to be ejected by the liquid ejecting head, the liquid ejecting apparatus further comprising recording mode selecting means for recognizing types of the liquids contained in the cartridges based on information provided from the cartridges and selecting one of the recording modes according to the types of the liquids contained in the cartridges.

11. The liquid ejecting apparatus according to claim 9, wherein the carriage is provided with a plurality of liquid supply needles to be inserted in the cartridges of respective colors.

12. The liquid ejecting apparatus according to claim 1, wherein the liquid ejecting head is provided with a plurality of pressure chambers respectively communicating with the plurality of nozzle openings, and pressure-producing elements for varying ink pressure in the pressure chambers, the pressure-producing elements including transverse or longitudinal mode piezoelectric vibrators.

13. A liquid ejecting apparatus comprising:

a liquid ejecting head provided with a plurality of nozzle rows each of which is formed by arranging a plurality of nozzle openings in a row, and capable of ejecting a plurality of types of liquids, a liquid of lightest color being supplied to the nozzle row nearest to an end of the liquid ejecting head with respect to a direction perpendicular to a direction in which the nozzle rows extend, and a liquid of darkest color being supplied to the nozzle row at a middle part of the liquid ejecting head with respect to the direction in which the nozzle rows extend;

a carriage mechanism including a carriage carrying the liquid ejecting head and capable of moving the carriage carrying the liquid ejecting head in scanning directions perpendicular to the direction in which the nozzle rows extend; and a controller capable of controlling the liquid ejecting head to eject the liquids through all of the plurality of nozzle rows of the liquid ejecting head both while the liquid ejecting head is being moved for a forward scanning stroke and while the liquid ejecting head is being moved for a backward scanning stroke, wherein the liquids are supplied to the plurality of nozzle rows such that colors of the liquids are symmetrically arranged with respect to the direction perpendicular to the direction in which the nozzle rows extend, wherein the carriage is configured to detachably hold at least two cartridges containing the liquids to be supplied to the plurality of nozzle rows, the carriage being configured such that only one or more cartridges for at least a part of the plurality of nozzle rows in either a right half part or a left half part of the liquid ejecting head can be replaced with other cartridges containing other liquids of similar color classes, respectively, wherein only the other cartridges containing the other liquids of the similar color classes are provided with storage devices storing information about the colors of the other liquids contained in the other cartridges, respectively, and wherein the carriage is provided with reading means for reading the information about the colors of the other liquids stored in the storage devices.

14. A liquid ejecting apparatus comprising:

a liquid ejecting head provided with a plurality of nozzle rows each of which is formed by arranging a plurality of nozzle openings in a row, and capable of ejecting a plurality of types of liquids, a liquid of lightest color being supplied to the nozzle row nearest loan end of the liquid ejecting head with respect to a direction perpendicular to a direction in which the nozzle rows extend, and a liquid of darkest color being supplied to the nozzle row at a middle part of the liquid ejecting head with respect to the direction in which the nozzle rows extend;

a carriage mechanism including a carriage carrying the liquid ejecting head and capable of moving the carriage carrying the liquid ejecting head in scanning directions perpendicular to the direction in which the nozzle rows extend; and a controller capable of controlling the liquid ejecting head to eject the liquids through all of the plurality of nozzle rows of the liquid ejecting head both while the liquid ejecting head is being moved for a forward scanning stroke and while the liquid ejecting head is being moved for a backward scanning stroke, wherein colors of the liquids respectively supplied to the plurality of the nozzle rows change from a dark color for the nozzle row at the middle part of the liquid ejecting head to a light color for the nozzle row nearest to the end of the liquid ejecting head with respect to the direction perpendicular to the direction in which the nozzle rows extend, wherein the number of the plurality of nozzle rows of the liquid ejecting head is eight, wherein a black-class ink is ejected through a pair of adjacent nozzle rows in the middle part of the liquid ejecting head with respect to the direction perpendicular to the direction in which the nozzle rows extend, a cyan-class ink is ejected through a pair of nozzle rows outwardly adjacent to the pair of nozzle rows through which the black-class ink is ejected, a magenta-class ink is ejected through a pair of nozzle rows outwardly adjacent to the pair of nozzle rows through which the cyan-class ink is ejected, and a yellow-class ink is ejected through a pair of nozzle rows outwardly adjacent to the pair of nozzle rows through which the magenta-class ink is ejected, wherein the black-class ink includes black and light-black inks, the cyan-class ink includes cyan and light-cyan inks, the magenta-class ink includes magenta and light-magenta inks, the yellow-class ink includes yellow and dark-yellow inks, wherein the black and the light-black ink are ejected through the pair of nozzle rows for the black-class inks, respectively, the cyan ink and the light-cyan ink are ejected through the pair of nozzle rows for the cyan-class inks, respectively, the magenta ink and the light-magenta ink are ejected through the pair of nozzle rows for the magenta-class inks, respectively, and the yellow ink and the dark-yellow ink are ejected through the pair of nozzle rows for the yellow-class inks, respectively, when the liquid ejecting head is operated in an eight-color recording mode, and wherein the black ink is ejected through the pair of nozzle rows for the black-class inks, the cyan ink is ejected through the pair of nozzle rows for the cyan-class inks, the magenta ink is ejected through the pair of nozzle rows for the magenta-class inks, and the yellow ink is ejected through the pair of nozzle rows for the yellow-class inks when the liquid ejecting head is operated in a four-color recording mode.

15. A liquid ejecting apparatus comprising:

a liquid ejecting head provided with a plurality of nozzle rows each of which is formed by arranging a plurality of nozzle openings in a row, and capable of ejecting a plurality of types of liquids, a liquid of lightest color being supplied to the nozzle row nearest to an end of the liquid ejecting head with respect to a direction perpendicular to a direction in which the nozzle rows extend, and a liquid of darkest color being supplied to the nozzle row at a middle part of the liquid ejecting head with respect to the direction in which the nozzle rows extend;

a carriage mechanism including a carriage carrying the liquid ejecting head and capable of moving the carriage carrying the liquid ejecting head in scanning directions perpendicular to the direction in which the nozzle rows extend; and a controller capable of controlling the liquid ejecting head to eject the liquids through all of the plurality of nozzle rows of the liquid ejecting head both while the liquid ejecting head is being moved for a forward scanning stroke and while the liquid ejecting head is being moved for a backward scanning stroke, wherein colors of the liquids respectively supplied to the plurality of the nozzle rows change from a dark color for the nozzle row at the middle part of the liquid ejecting head to a light color for the nozzle row nearest to the end of the liquid ejecting head with respect to the direction perpendicular to the direction in which the nozzle rows extend, wherein the number of the plurality of nozzle rows of the liquid ejecting head is eight, wherein a black-class ink is ejected through a pair of adjacent nozzle rows in the middle part of the liquid ejecting head with respect to the direction perpendicular to the direction in which the nozzle rows extend, a cyan-class ink is ejected through a pair of nozzle rows outwardly adjacent to the pair of nozzle rows through which the black-class ink is ejected, a magenta-class ink is ejected through a pair of nozzle rows outwardly adjacent to the pair of nozzle rows through which the cyan-class ink is ejected, and a yellow-class ink is ejected through a pair of nozzle rows outwardly adjacent to the pair of nozzle rows through which the magenta-class ink is ejected, wherein the black-class ink includes a black ink, the cyan-class ink includes cyan and light-cyan inks, the magenta-class ink includes magenta and light-magenta inks, the yellow-class ink includes yellow and dark-yellow inks, wherein the cyan ink and the light-cyan ink are ejected through the pair of nozzle rows for the cyan-class inks, respectively, the magenta ink and the light-magenta ink are ejected through the pair of nozzle rows for the magenta-class inks, respectively, and the yellow ink and the dark-yellow ink are ejected through the pair of nozzle rows for the yellow-class inks, respectively, when the liquid ejecting head is operated in a seven-color recording mode, wherein the cyan ink is ejected through the pair of nozzle rows for the cyan-class inks, the magenta ink is ejected through the pair of nozzle rows for the magenta-class inks, and the yellow ink is ejected through the pair of nozzle rows for the yellow-class inks when the liquid ejecting head is operated in a four-color recording mode, wherein the carriage is configured to individually and detachably hold the cartridges respectively containing the liquids of different colors to be ejected by the liquid ejecting head, and wherein the liquid ejecting apparatus further comprising recording mode selecting means for recognizing types of the liquids contained in the cartridges based on information provided from the cartridges and selecting one of the recording modes according to the types of the liquids contained in the cartridges.

* * * * *